US005503489A

United States Patent [19]

Maudal

[11] Patent Number: 5,503,489

[45] Date of Patent: Apr. 2, 1996

[54] DOUBLE APERTURE PAPER LIFTER

[76] Inventor: Inge Maudal, 604 Lassen La., Costa Mesa, Calif. 92626-3122

[21] Appl. No.: 262,487

[22] Filed: Jun. 20, 1994

[51] Int. Cl.[6] ..... B42F 13/00

[52] U.S. Cl. ..... 402/80 L; 402/80 R

[58] Field of Search ..... 402/80 R, 80 L; 281/28, 38, 51

[56] References Cited

U.S. PATENT DOCUMENTS

| | | | |
|---|---|---|---|
| 1,770,670 | 7/1930 | Raynolds | 402/80 L |
| 2,276,987 | 3/1942 | Kengott | 402/80 L |
| 2,505,694 | 4/1950 | Stuercke | 402/80 L |
| 3,306,301 | 2/1967 | Mason | 402/80 L |
| 3,366,118 | 1/1968 | Beyer | 402/80 L |

*Primary Examiner*—Willmon Fridie, Jr.

[57] ABSTRACT

A paper lifter and a loose-leaf ring binder combine to form a class two lever system. The lifter has two sets of apertures. A first set fits slidably over the rings. A curved load arm reaches inward from the apertures and abuts a plate protecting the binder ring mechanism; the curvature provides a variable length load arm with lifter angle. The contact point between the load arm and the plate becomes a system fulcrum; yet the contact point (and the lifter) is free to slide along the plate. An effort arm extends oppositely to reach and slide against the binder cover. A second set of apertures are slots in the curved load arm. The slots, in line with the rings, prevent ring interference with continuous contact between the load arm and the plate. The system fulcrum then remains on the plate for the first and critical phase of the closing motion.

17 Claims, 4 Drawing Sheets

DOUBLE APERTURE PAPER LIFTER

BACKGROUND OF THE INVENTION

1. Field of the Invention

This invention relates generally to the art of loose-leaf ring binders and particularly to paper lifters co-acting with binder rings to manage papers.

2. Prior Art

A paper lifter is a generally rectangular plate having apertures adapted to fit onto the rings in a loose leaf ring binder. As a member of a type two lever system the lifter also interacts with the binder book covers and a protective plate for the ring mechanism. The elongated side of the rectangle is generally aligned with the back of the ring binder. The apertures are placed approximately in the middle of the transverse side of the rectangle. Extending outward over the binder cover is a generally flat surface adapted to lie against the cover and to act as an effort (input) arm of the lever system. Extending inwards toward the center of the ring mechanisms is a surface adapted to abut and slide against the ring mechanism and to provide a load arm and fulcrum for a type two lever system. Load points, for lifting papers, are generally at or near the shoulders of the apertures. The prior an generally refers to ring binders, loose-leaf ring binders, rings or split rings, paper lifters, sheet lifters, paper inserts, punched papers, pre-punched sheet, and the like. It is understood that paper sheets and rings coact, thus the spacing of punched holes and rings are a combination. Although "rings" in general are circular, or semi circular in shape, they are in effect merely prongs which receive the punched papers or sheets, and may have many shapes. These range from true rings, to straight bars or rods, to substantially rectangular prongs, and to paired combinations of rings and bars or other paired combination of shapes. The following uses of "rings" will not be restricted to circular shapes, but will include any shapes and labels in general use.

Three rings, or sets of split rings, are the most common number of rings in a given loose-leaf binder. This constitute a set which is generally duplicated in the number of holes in the paper inserts, punched papers, sheet, and paper lifters. However, two and seven rings are common examples in combination with corresponding sets of punched holes in loose sheet.

Prior art portrays several sheet lifters. These lifters have in common a general lack of acceptance by the public; reasons include nonperformance, too unwieldy to use, and too expensive to produce. General reviews of the prior art are found in the references below and will therefore not be repeated. Specific attention will be directed to the following patents:

1. Lewis R. Beyer: "Sheet Lifter," U.S. Pat. No. 3,366,118, dated Jan. 30, 1968, hereinafter Beyer;
2. R. J. Kenkott: "Sheet Lifting Device for a Loose Leaf Binder," U.S. Pat. No. 2,276,987, dated Mar. 17, 1942, hereinafter Kenkott; and
3. J. B. Stuerke: "Fulcrum for Loose Leaf Binders," U.S. Pat. No. 2,505,694, dated Apr. 25, 1950, hereinafter Stuercke.

The Beyer patent shows a standard ring binder with a protective plate over the ring mechanism. An elongated paper lifter inserts transversely over the rings through a plurality of apertures. An inner curved surface extends over the plate and ends in an uninterrupted edge; the curvature is sufficient to rotate the edge to lie flat against the inner circumference of each ring. The apertures and the edge are pressure points acting against the rings; they span an angular arc that is large enough to create components of force that move the lifter along the rings. Outward-sloping ribs are placed on top of the lifter and extend over and well beyond the apertures; their purpose is to slide binder papers away from the rings to prevent tearing of the papers. Ribs are also placed on the underside of the curved surface to prevent opposite pairs of lifters to interlock.

The Beyer patent places emphasis on obtaining sufficient spacing between the pressure points to move the lifter along the rings. The separation between the inner edge and the apertures is therefore determined while both pressure point are against the rings. As a consequence, when the lifter lies flat (ring binder open), the inner edge does not contact the protected plate but is instead suspended well above the plate. Only after rotating a considerable angle following first motion does the inner edge reach the plate. During this initial motion the lifter pivots about the apertures only; consequently, there is no motion of the lifter apertures along the rings. The apertures therefore catch and tear the papers in the binder. The outward-sloping ribs are inserted to solve this problem, thus causing additional complexity.

The Kencott patent also shows a standard ring binder with a protective plate and lifter apertures engaged with the rings. The load end cuffs upward over the plate and then closes upon itself to form a closed rocker with an upper shelf. The end of the shelf has a small semicircular notch that abuts the ring. In operation the lifter leverages on the curved rocker portion and rides up the ring on the notch in the shelf end; the shelf pushes the paper sheets.

It is noted that the rockers must be large to provide a high enough step to raise the paper sheets sufficiently. Thus the rockers become large enough to abut each other when installed as opposing pairs in the ring binder, yet they may not be large enough to fully raise the paper sheets. However, the suspected deficiency is neatly avoided by claiming beneficial co-action between the opposing lifters. One suspects, however, that this co-action may result in un-beneficial entanglements.

The Stuercke patent shows improvements upon the Kencott invention. One improvement consists of a raised surface mounted on top of the protected plate. This surface serves as an artificial protective plate and raises the height of the lifter. A second improvement is a guide that engages the closed rocker and limits unwanted movements of the lifter. These improvements expressly confirm the reservations noted above about the Kencott invention; yet they solves the problem. The result, however, is a cumbersome addition to a prior device.

SUMMARY OF THE INVENTION

This invention improves upon paper lifters for loose-leaf ring binders by aligning lift forces tangentially to the binder rings at the points of co-action between rings and lifter apertures. In this way the lifter pushes papers before it cleanly without catching and tearing them.

The invention is prompted by the realization that the general lose-leaf ring binder present two different abutment interfaces to a paper lifter. The first interface, a protective plate over the ring mechanism, presents a generally flat surface. The second interface, the rings emanating from the ring mechanism and the protective plate, present generally circular abutment edges. The paper lifter leverages against the flat protective plate in the first instance; the paper lifter leverages against the inner edges of the rings in the second instance.

Further significance is assigned to the exit angle of the rings at the exit holes in the protective plate. Here the curvature produces exit angles-exceeding thirty degrees.

Consider the operation during the binder closing phase with the lifter pivoting about the load arm abutment with the protective plate. The binder initially lies open on a flat surface; the lifter now lies parallel to the flat surface, to the protective plate, and to the binder cover. The load centered apertures lies over the ring exit holes, the load arm extends over the protective plate, and the effort arm extends over the binder cover. An inner edge-of the load arm abuts the protective plate. The effort force, the input applied .by the binder cover, and the fulcrum force, the reflection at the load arm abutment with the protective plate, are both normal to the lifter. The resulting force developing at the load points near the apertures is also normal. Because the ring exit angle at the exit holes is large, the component of the force acting tangentially to the rings is significant. The tangential component thus slides the lifter, and binder papers, easily along the ring while pivoting about the load arm abutment point with the protective plate.

As the closing motion continues, the lifter rotates in angle with respect to the protective plate. As this angle increases, a smaller and smaller component of the effort force will be tangent to the rings. However, a larger and larger component of the fulcrum force will align itself with the lifter load arm. This force is tangential to the rings and will compel the lifter load point to slide up the rings.

As the closing motion continues the load arm abutment with the protective plate slides outward to the rings emerging through the exit holes. At this point the lifter abutment transfers from the protective plate to the rings; the operation now reaches the second instance mentioned above. The advantageous separation of the fulcrum force, with one component along the load arm, is lost. Instead, the tangential forces now depend on the arc on the tings spanned by the pressure points of Beyer.

This invention retains the favorable force separation characterized by the physical connection of the load arm with the protective plate. It does so by providing two sets of apertures, a first set as holes matching the rings and a second set as slots aligned with the rings. The first set guides the lifter along the rings; the second set provides clearance allowing the lifter to abut the ring mechanism protective plate throughout its operation.

As a result, the preferred lifter embodiment of this invention operates in three phases. In the first phase a lifter abutment means slides against the protective plate. In a second phase slots, cut in the abutment means, allow the abutment arm to move beyond the rings. The lifter now slides on the abutment means extending inward on the lifter. The means is curved to obtain a load arm, the length between the abutment means and the lifter holes, that is proportional to the lifter angle; increasing the lifter angle lengthens the arm and slides the lifter tangentially up the rings. In the third phase the slots bottom out; now the rings provide the leverage for the lifter. The third phase therefore reverts to the Beyer system.

OBJECTS OF THE INVENTION

It is a principal object of this invention is to obtain an improved paper lifter in a loose-leaf ring binder that will easily move the loose-leaf papers without binding or tearing the papers.

It is also a principal object of this invention to obtain a lifter which operates with a large moment arm to facilitate forceful movement of loose-leaf papers in a loose-leaf note book.

It is another principal object of this invention to manage loose-leaf sheets of papers in a binder even when the binder is jammed too full of sheets.

DETAILED DESCRIPTION OF PREFERRED EMBODIMENTS

Figure 1:
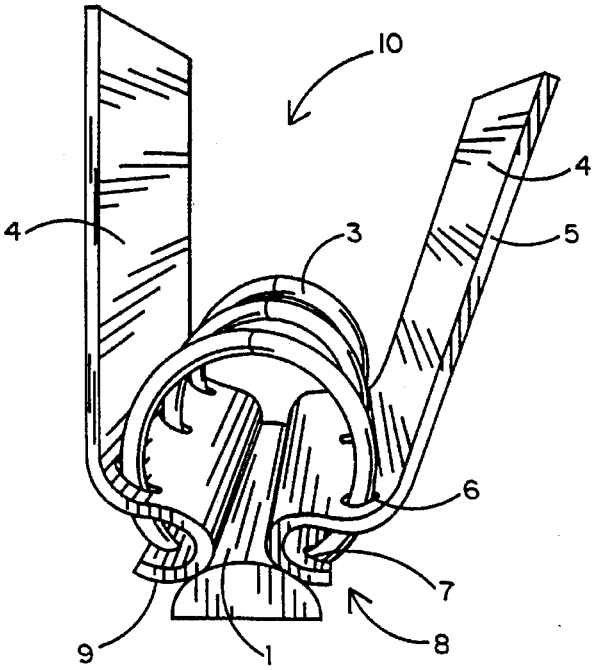
FIG. 1 is a perspective view of a lever system formed by the preferred embodiment of the invention and the rings of a loose leaf binder.

A preferred embodiment of this invention, designated by the numeral 10, is shown in a class two lever system in FIG; 1. There is shown a general combination of three split rings 3 of a loose leaf binder, a curved protective shield 1 for ring mechanisms, and paper lifters 4 of this invention. The rings 3 and the protective shield 1 are parts of a standard ring binder; in this case a three ring binder. The protective shield 1 fastens to the ring mechanism which again fastens to a binder book back. The rings 3 exit from the binder protective shield 1 through two rows of exit holes 2 running parallel to the outside edges of shield 1. The ring mechanism, binder back, and covers are not shown.

FIG. 1 shows a generally rectangular extent of the paper lifter 4 with two sides and two widths. Two elongated lifter sides run parallel with and substantially the length of the protective shield 1. The lifter may be formed from a generally flat blank of pressed paper which may then be shaped to desired curvatures; it may also be formed from plastic material. A row of guide holes 6 run the length and substantially in the middle of each lifter 4; the guide holes 6 are spaced to rotate on the rings 3 and large enough to also slide easily along the rings 3. Guide holes 6 has inner edges 11 and outer edges 12. The lifter widths extend crosswise from the guide holes 6: in an outward direction to substantially reach out over the binder cover to form a lever arm 5, in an inward direction to substantially reach over the protective shield 1 with a load arm 15 to an abutment end 8.

Figure 2A:
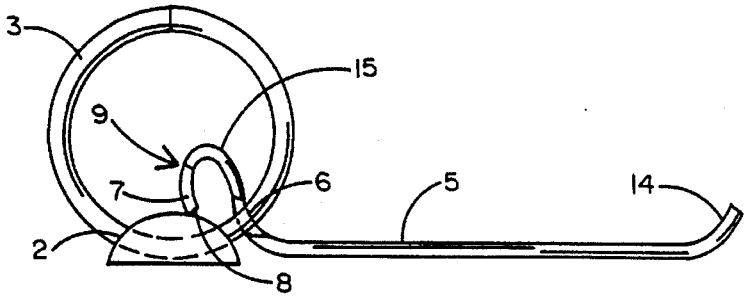
FIG. 2 is a side view of the preferred embodiment.
Figure 2B:
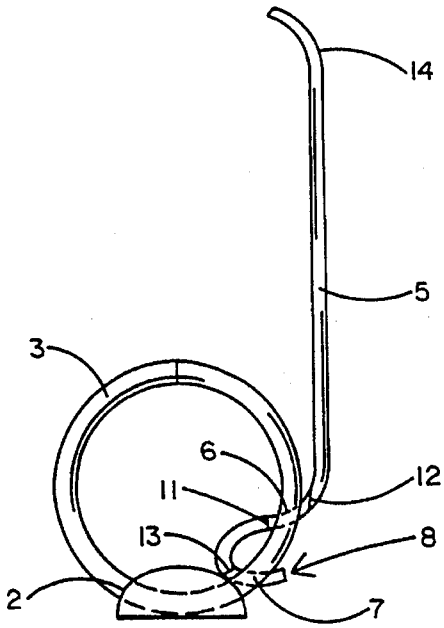
Figure 3A:
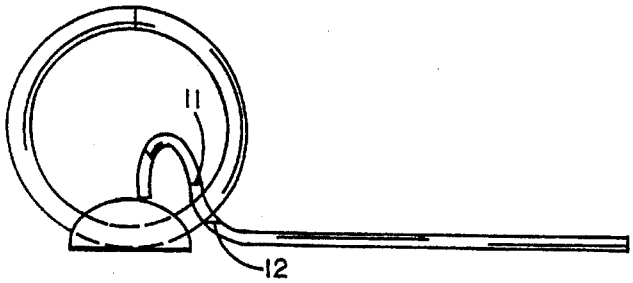
FIG. 3 is side views of a sequence of lifter positions during closing operation.
Figure 3B:
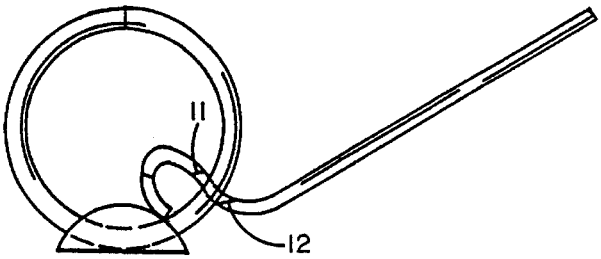
Figure 3C:
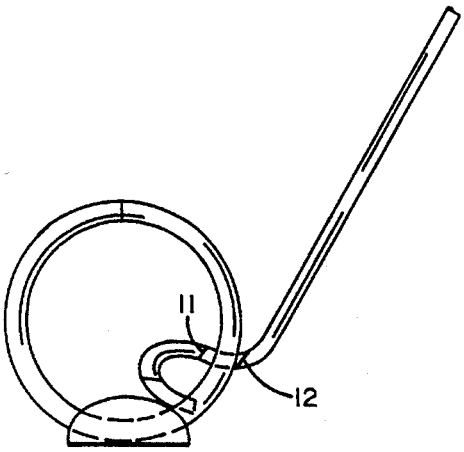
Figure 3D:
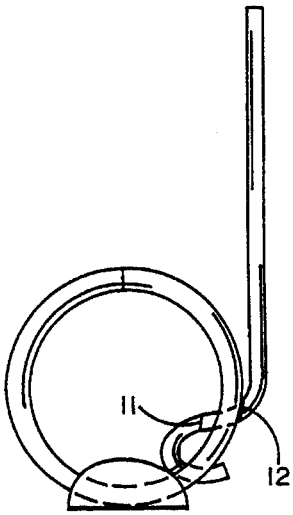
Figure 3E:
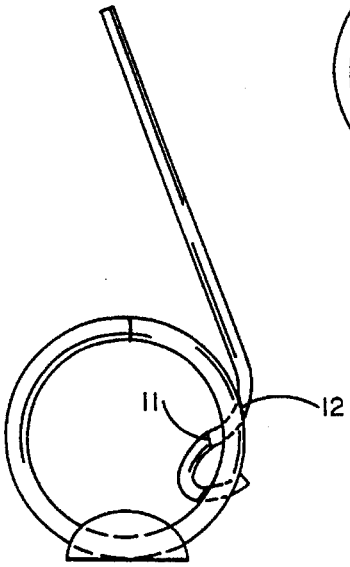
Figure 4A:
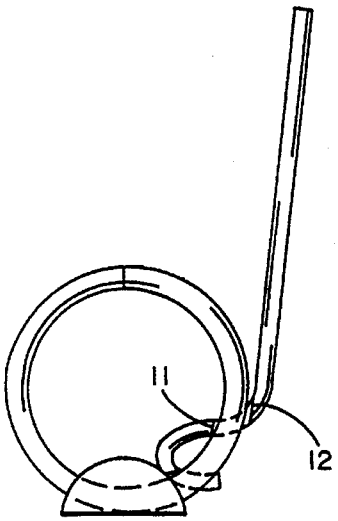
FIG. 4 is side views of a sequence of lifter positions during opening operation.
Figure 4B:
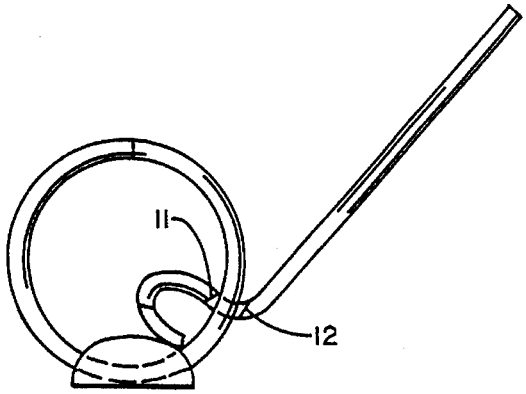
Figure 4C:
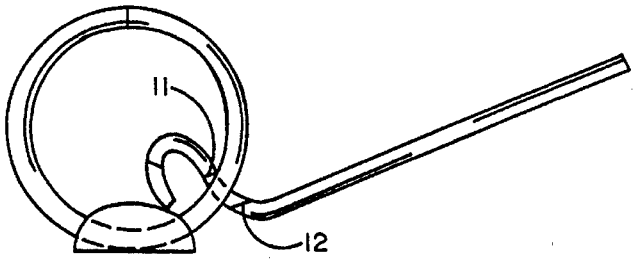
Figure 4D:
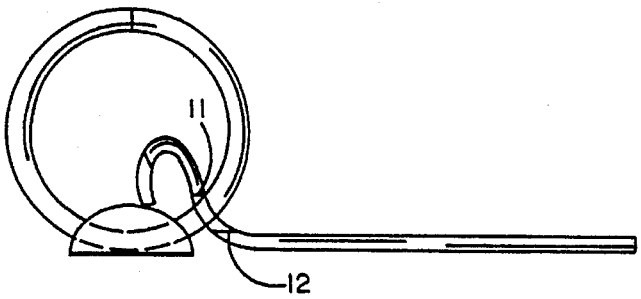

FIG. 2(*a*) depicts an end view of a first preferred embodiment of the lifter. Lever arm 5 bends substantially 20–50 degrees from a plane containing the guide holes 6; from thence it extends outward over the binder cover (not shown) substantially as a flat rectangle. The rectangle terminates in an upwardly curved outer edge 14.

A load arm 15 reaches inward over the protective shield 1 from the guide holes 6 to terminate in abutment end 8. The abutment end 8 lies above the plane of the rectangular lever arm 5 substantially by an angle between 20–50 degrees; it is initially in contact with the protective shield 1.

A fulcrum surface 9 extends from the abutment edge 8 and reaches in a generally upward direction. It may be described relative to reference radius vectors beginning in the outer edges 12 of the guide holes 6 and ending in a reference line originally coincident with the abutment edge 8. The plan shape of the fulcrum surface 9 is partially defined by the radius vectors rotating the reference line upward, or clockwise in FIG. 2(*a*), about an axis through the outer edges 12 of the guide holes 6. In addition, the radius vectors increases in length with rotation angle to form the fulcrum surface 9 substantially similar in cross section to a spiral. This leaves the fulcrum surface 9 substantially on top of the load arm 15. The increase in vector length causes the lifter to effectively rotate about an axis in the center of the split rings of the loose leaf binder.

Open slots 7, adapted to loosely admit the rings 3, are cut normal to the abutment edge 8 and continues fully through the fulcrum portion described by fulcrum surface 9. The slots 7 end in inner edges 13 corresponding to the inner end of the fulcrum portion described by fulcrum surface 9.

The total rotation angle of the reference vectors, and thus the extent of the fulcrum surface 9 and slots 7, depends generally on the cross sectional shape of the lifter. The angle generally may range from substantially 15 to 35 degrees; in the first preferred embodiment this angle is substantially 30 degrees. The requirements are dependent on the operation of the lifter and will be described in this context below.

A distinguishing feature of the lifter is the presence of two sets of apertures. One set, the guide holes 6, pivotally anchors the lifter to the rings while also enabling movement up and down the rings. A second set, the slots 7, allows the abutment end 8 and the abutment arch 9 to slide past the rings at high angles of incidence of the lifter. This allows continued contact between the abutment end 8 or arch 9 and the plate 1 during the first phases of lift operation.

A side view in FIG. 2 shows a further detailed illustration of the lifter; FIG. 2(*a*) shows the system with the loose leaf binder (not shown) open, FIG. 2(*b*) shows the system with the loose leaf binder (not shown) closed. The lifter is threaded on split rings 3 through the guide holes 6; the guide holes have inner edge 11 and outer edge 12 as shown. The slots have inner edges 13.

In operation the lifter undergoes a continuous rotation representing intermediate positions between the extremes shown in FIG. 2(*a*) and FIG. 2(*b*).

FIG. 2(*a*) shows the beginning of a closing cycle. In this phase the abutment end 8 rests on the ring mechanism plate 1, the leverage arm 5 rests flat against the open ring binder cover, and the guide hole outer edge 12 rides against the outer circumference of the rings 3. Together the combination is a class 2 lever system. The leverage arm 5 serves as an effort arm receiving input forces from the binder cover (not shown), the guide hole 6 and outer edge 12 serve as load points acting on papers in the ring binder (not shown), the abutment edge 8 and plate 1 serves as a fulcrum, and the distance between the fulcrum and the outer edge 12 is the load arm 15. The fulcrum in this lifter position is well away from the exit hole 2 and there is no danger of interference by the rings 3.

It is important that the abutment end 8 be in physical contact with the plate 1 at the beginning of the closing phase. There is now immediate tangential motion of the load point along the rings, rather than only a pivoting motion of the lifter, when the binder cover applies force to the leverage arm. This feature avoids catching and tearing of papers, especially when the binder is too full of loose-leaf papers.

As the closing cycle continues, the contact with plate 1 changes from the abutment edge 8 to the abutment arch 9. FIG. 2(*b*) shows lifter position at the completion of a closing cycle. The abutment end 8 no longer contacts the plate 1; the fulcrum is now formed by the abutment arch 9 resting against the plate 1 instead. The open slots 7 are now fully engaged with the rings 3; the slots allow the abutment arch 9 to maintain contact with the plate 1 up to this point.

At this point the slot inner edge 13 comes into actual contact with the rings 3. Therefore, during any further closing motion, the motive force couple is now provided by contact points on the rings; thus the slot inner edge 13 and the guide hole outer edge 12 form pressure points according to Beyer. In this position the binder cover provides a more advantageous force direction; the Beyer force couple is therefore sufficient to move the lifter additionally up the rings.

FIG. 3 shows the operation of the lifter during the three phases of the binder closing in a sequence of lifter positions. (See FIG. 2 for detail parts reference). FIG. 3(*a*) shows the binder open, and thus the start of phase 1. In this phase the abutment end 8 creates a fulcrum for the lever system with physical contact with the plate 1. It also slides across the plate 1, creating a moving fulcrum; the lifter pivots about this throughout phase 1.

FIG. 3(*b*) and FIG. 3(*c*) show the lifter leverage arm 5 raised to approximately 30 and 60 degrees respectively. The drawings mark a transition between phase 1 and phase 2. In FIG. 3(*b*) the abutment end 8 is close to the exit holes 2 and the rings 3; there is yet no interference by the rings. In FIG. 3(*c*) the abutment end 8 has moved past the exit hole 2 and the rings 3. In this position the rings 3 has entered the open slots 7; the slots 7 therefore prevent interference by the rings and permit continued contact between the abutment end 8 and the plate 1.

FIG. 3(*b*) and FIG. 3(*c*) also show a transition of the fulcrum from the abutment end 8 to the abutment arch 9. The apparent correlation to the transition from phase 1 to phase 2 is accidental. The lifter positions shown in FIG. 3(*b*) and FIG. 3(*c*) show that there would be a high angle of incidence between the lifter leverage arm 5 and the cover surface (not shown). The leverage arm may be curved, as in curved outer edge 14, at the outer edge to avoid excessive friction.

FIG. 3(*d*) shows the leverage arm 5 raised to approximately 90 degrees and depicts the completion of phase 2 and the beginning of phase 3. The rings have now completely invaded the open slots 7 and rest against the slot inner edge 13. The lifter now leverages against the rings 3; consequently, the lifter abutment arch 9 loses contact with the plate 1 and the lifter will move up the ring circumference in the fashion of the Beyer patent. FIG. 3(*e*) shows the lifter position during phase 3. The force couple resulting from pressure points depends on the trigonometric sine function of an angle spanned by the pressure points. To achieve a sufficient force couple this angle should exceed 20 degrees, thus converting approximately one third or more of the applied force to tangential force.

The fulcrum surface 9 defines the phase 2 rotation, namely the rotation of the lift substantially between the positions shown in FIG. 3(*b*) and FIG. 3(*d*). The opposite angle of rotation of the reference line, from the inner slot edge 13 to the abutment edge 8, therefor define the fulcrum surface 9 as that angle within which the fulcrum surface 9 is in contact with the shield 1. The contact line, or fulcrum, then determines the distance between the fulcrum and the outer edges 12 of the guide holes. The angle also define the depth of slots 7. This angle in the first preferred embodiment is substantially 20–30 degrees.

FIG. 4 shows the lifter in operation during binder opening in a sequence of lifter positions. (See FIG. 2 for reference to detail parts). During the opening phase the lifter slides against the rings on the guide hole inner edge 11 while gravity lowers the leverage arm 5; the abutment arch 9 simultaneously slides against the plate 1. It is important that the shape of the abutment arch 9 prevent the abutment arch 9 and abutment end 8 from catching on the plate 1 causing hang-ups. Therefore, the spiral shape of the abutment arch 9, centered in the guide hole inner edge 11, must have a sufficient decreasing radius to slide easily off the edge of the plate 1. Thus, the angle between a line that is tangent to the fulcrum and a line from the fulcrum to the inner edge 11 must be less that 90 degrees for any angle of the lifter. The first preferred embodiment requires that this angle be less that 85 degrees.

Figure 5:
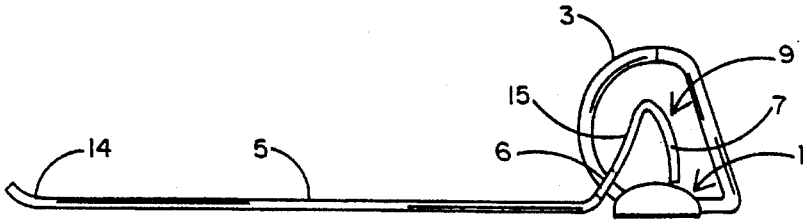
FIG. 5 is a side view of a second preferred embodiment of a single sided lifter.

FIG. 5 shows a second preferred embodiment of this invention applicable to a loose-leaf binder with two covers and a book back hingedly mounted therebetween. An operating mechanism is mounted on one book cover substantially near the book back and supports and controls a plurality of pairs of prongs spaced to receive punched papers. The operating mechanism supports one split ring in each pair; the companion prong is a straight bar. The rings are mounted nearest the book back curving away, the bars are mounted away and slanting substantially toward the book back. A protective shield 1 caps the operating mechanism.

A lifter in this combination has the guide holes 6 of the first embodiment. However, the lifter is mounted on the rings so that the load arm reaches outward away from the book back (toward punched sheets) while the lever arm reaches toward the book back.

This type of ring binder requires one lifter only; however, the needed angle of operation is 180 degrees instead of the 90 degrees of the conventional ring binder. The additional angle of rotation requires that the lifter be able to push the papers over the top of the semi-rings. Therefore, the length of the load arm and fulcrum surfaces must be longer. Similarly, the leverage arm for these lifters must reach across the binder book back to the opposite book cover to function well. The leverage arm is therefore significantly longer than in the first embodiment.

The principle of the lifter construction and the three phases of operation are the same as for the first preferred embodiment, only scales factors are changed. A full description would parallel the prior description and will not be repeated.

Figure 6A:
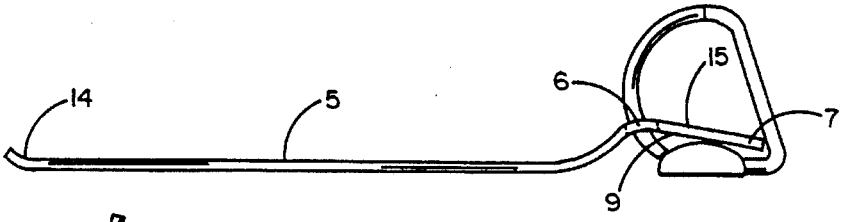
FIG. 6 is a side view of a third preferred embodiment of a single sided lifter.
Figure 6B:
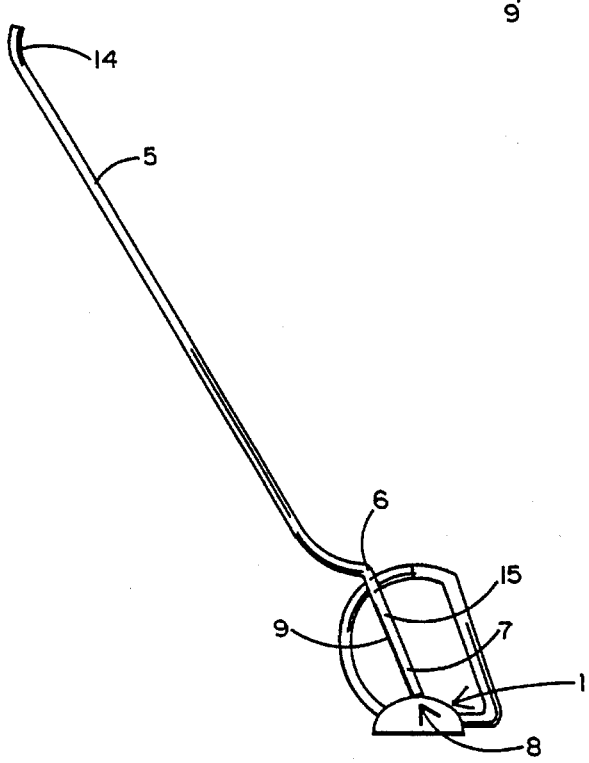
Figure 6C:
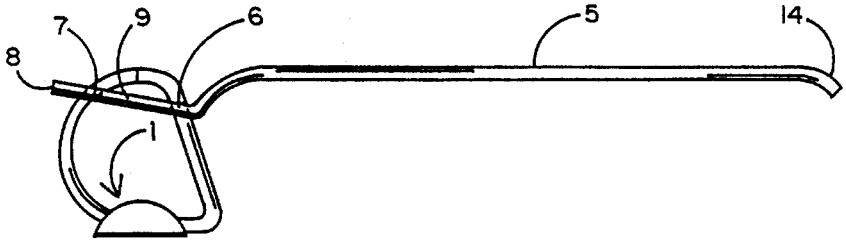

FIG. 6(*a*) shows a third preferred embodiment having the same loose-leaf binder as in the second embodiment. A substantially straight load arm 15 extends from the guide holes 6 over and past the protective shield 1; the length of the load arm 15 substantially equals or slightly exceeds that of the inner diameter of the split rings 3. The outer substantially one half of the load arm 15 constitute a fulcrum portion defined by fulcrum surface 9; the fulcrum surface 9 in this embodiment lie on the underneath part of the fulcrum portion. Slots 7 are cut and extend through the fulcrum portion.

In operation the lifter starts off lying flat, as in FIG. 6(*a*), on the opened ring binder (not shown). The contact between fulcrum surface 9, located under load arm 15, and shield 1 form a shifting fulcrum. As rotation continues, as in FIG. 6(*b*), the fulcrum shifts to abutment end 8. After further rotation the abutment end 8 loses contact with the shield 1 and the lifter suddenly pivots about the guide holes 6 until slots 7 clears the semi-rings 4 and inner slot edge 13 abuts the semi-rings 4. The motive force couple is now provided by contact points on the rings; thus the slot inner edge 13 and the guide hole outer edge 12 form pressure points-according to Beyer. FIG. 6(*c*) shows the lifter rotated a full 180 degrees; the slots 7 clears the rings 3 and permits the lifter to lie flat against loose leaf papers (not shown). Further descriptions parallel the above description and will not be repeated.

Thus, there has been provided, according to the invention, an improved paper lifter that is economical to use. It is to be understood that all the terms used herein are descriptive rather than limiting. Although the invention has been described in conjunction with the specific embodiments set forth above, many alternative embodiments, modifications and variations will be apparent to those skilled in the an in light of the disclosure set forth herein. Accordingly, it is intended to include all such alternative embodiments, modifications and variations that fall within the spirit and scope of the invention as set forth in the claims hereinbelow.

I claim:

1. A paper lifter in combination with a loose-leaf binder having book covers, a book back therebetween, an operating mechanism mounted on the book back, and a plurality of paired prongs emerging through apertures in a shield protecting the operating mechanism, the paper lifter comprising:

an elongated lifter blank substantially rigid and rectangular in outline;

a set of guide holes in the lifter blank spaced and sized to slidably and rotatably couple the lifter blank to one side of the prongs;

an effort portion extending from the guide holes to an outer edge;

a load portion extending oppositely from the guide holes to a fulcrum portion with an inner edge, the fulcrum portion having a fulcrum surface slidably and pivotally abutting the shield; and a set of clearance slots in the fulcrum portion positioned in line with the prongs.

2. A paper lifter of claim 1 wherein the fulcrum surface is curved.

3. A paper lifter of claim 2 wherein the curved fulcrum surface coincides with a geometric shape formed by rotating the inner edge about an axis substantially aligned with the set of guide holes; said curved fulcrum surface forming a shifting fulcrum between the fulcrum surface and the shield corresponding to an angle of rotation of the lifter relative to the shield.

4. A paper lifter of claim 3 wherein distances between the shifting fulcra and the guide holes change with angle of rotation.

5. A paper lifter of claim 4 wherein an angle between a plane that is tangent to the shifting fulcrum and a line from the fulcrum to the guide holes must be less than ninety degrees for any angle of the lifter with respect to the shield to avoid lifter hang-ups.

6. A paper lifter of claim 1, wherein inner edges of the set of clearance slots and the set of guide holes form pressure points in combination with the prongs.

7. A paper lifter of claim 1 wherein the outer edge curves away from the cover.

8. A paper lifter for hole punched filler sheets in combination with a loose-leaf binder having book covers, a book back with a center axis hingedly attached therebetween, the covers movable to open and to close positions, the combination comprising:

a plurality of split retaining rings spaced apart in opposite pairs along the center axis of the book back and adapted to open and close, the rings forming a set adapted to receive and hold the hole punched filler sheets;

an operating mechanism for supporting, opening, and closing the rings, the operating mechanism placed substantially on the book back along the center axis;

a protective shield centered on and covering the operating mechanism, the shield having a set of apertures through which a major portion of the rings protrude;

a lifter blank, substantially rigid and rectangular in outline;

a set of guide holes in the lifter blank, spaced and sized to slidably and rotatably couple the lifter blank to the rings;

an effort portion extending from the guide holes to an outer edge;

a load portion extending oppositely from the guide holes to a fulcrum portion with an inner edge, the fulcrum portion having a fulcrum surface slidably and pivotally abutting the shield; and a set of clearance slots in the fulcrum portion positioned in line with the rings.

9. A paper lifter of claim 8 wherein the inner edge extends short of the center axis of the book back to avoid entanglement with an oppositely positioned companion lifter placed over the opposite split retaining ring.

10. A paper lifter for hole punched filler sheets in combination with a loose-leaf binder having book covers, a book back hingedly attached therebetween, the covers movable to open and to closed positions, the combination comprising:

a plurality of spaced apart pairs of retaining prongs, a first prong of the pair semi-circular, a second prong a substantially straight bar, said spaced apart pairs forming a set adapted to receive and hold the hole punched filler sheets;

an operating mechanism for supporting, opening, and closing the prongs, said operating mechanism placed on one of the covers substantially next to the book back;

a protective shield covering the operating mechanism, the shield having a set of apertures through which a major-portion of the prongs protrudes;

a single lifter blank, substantially rigid and rectangular in outline;

a set of guide holes in the lifter blank, spaced and sized to slidably and rotationally couple the lifter blank to the set of first prongs;

an effort portion extending from the guide holes to an outer edge;

a load arm extending oppositely from the guide holes to a fulcrum portion with an inner edge, the fulcrum portion having a fulcrum surface slidably and pivotally abutting the shield; and a set of clearance slots in the fulcrum portion positioned in line with the set of prongs.

11. A paper lifter of claim 10 wherein the fulcrum surface is substantially a spiral surface about an axis substantially aligned with the set of guide holes; said fulcrum surface and the shield forming a shifting fulcrum corresponding to an angle of rotation of the lifter.

12. A paper lifter of claim 10 wherein the fulcrum surface is substantially longer that the diameter of the rings.

13. A paper lifter of claim 10 wherein the effort member extends across the book back to coact with the opposite cover.

14. A paper lifter of claim 10 wherein inner edges of the set of clearance slots and the set of guide holes form pressure points in combination with the prongs.

15. A paper lifter of claim 10 wherein the outer edge curves away from the cover.

16. A paper lifter of claim 8 wherein the fulcrum surface lies substantially on a top of the fulcrum portion.

17. A paper lifter of claim 10 wherein the fulcrum surface lies on an underside of the fulcrum portion.

* * * * *